US008464369B2

(12) United States Patent
Furseth

(10) Patent No.: US 8,464,369 B2
(45) **Date of Patent: *Jun. 18, 2013**

(54) SLIP-FIT CLAMPING SYSTEM FOR MOUNTING A FITTING ON A WALL

(75) Inventor: Michael R. Furseth, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/408,758

(22) Filed: Feb. 29, 2012

(65) Prior Publication Data

US 2012/0153616 A1 Jun. 21, 2012

Related U.S. Application Data

(63) Continuation of application No. 12/244,423, filed on Oct. 2, 2008, now Pat. No. 8,214,941.

(51) Int. Cl.
*E03C 1/04* (2006.01)

(52) U.S. Cl.
USPC ..... 4/678; 4/675; 4/676; 4/677; 4/695

(58) Field of Classification Search
USPC ..... 4/678, 675, 676, 677, 695; 248/74.1, 248/74.4
See application file for complete search history.

(56) References Cited

U.S. PATENT DOCUMENTS

| | | | | |
|---|---|---|---|---|
| 2,997,058 A | | 8/1961 | Hall | |
| 3,086,748 A | | 4/1963 | Reinemann | |
| 3,136,570 A | | 6/1964 | Lee | |
| 3,312,402 A | | 4/1967 | Lyon | |
| 3,419,914 A | | 1/1969 | Moen | |
| 3,473,558 A | | 10/1969 | Mongerson | |
| 3,576,197 A | * | 4/1971 | Bastian | 137/359 |
| 3,602,244 A | | 8/1971 | Ward | |
| 3,640,305 A | | 2/1972 | Young | |
| 3,656,503 A | | 4/1972 | Ward | |
| 3,739,806 A | | 6/1973 | Bucknell et al. | |
| 3,746,031 A | | 7/1973 | Christiansen | |
| 3,866,629 A | | 2/1975 | Nicklas | |
| 3,871,406 A | | 3/1975 | Anderson | |
| 4,084,620 A | * | 4/1978 | Bucknell et al. | 137/801 |
| 4,116,210 A | | 9/1978 | Nelson | |

(Continued)

FOREIGN PATENT DOCUMENTS

GB 2416120 A 1/2006

OTHER PUBLICATIONS

Preliminary Amendment for U.S. Appl. No. 12/244,423, mail date Feb. 12, 2010, 7 pages.

(Continued)

*Primary Examiner* — Brian Glessner
*Assistant Examiner* — Joshua Ihezie
(74) *Attorney, Agent, or Firm* — Foley & Lardner LLP

(57) ABSTRACT

Disclosed are fittings (e.g. tub spouts) suitable for mounting to a member (e.g. a water pipe). Special clamping structures are provided and located in a cavity of a fitting body. The clamping structures have at least two separate clamp parts that surround the water pipe or other member. A set screw can be extended radially inward from a hole in the fitting body to drive a clamp part. This helps to retain the end of the member in the cavity, while distributing clamping load away from a single point.

20 Claims, 5 Drawing Sheets

U.S. PATENT DOCUMENTS

| | | | |
|---|---|---|---|
| 4,117,858 | A | 10/1978 | Bucknell et al. |
| 4,383,998 | A | 5/1983 | Esanu |
| 4,387,738 | A | 6/1983 | Bisonaya et al. |
| 4,393,998 | A | 7/1983 | Allen et al. |
| 4,750,762 | A | 6/1988 | Corzine |
| 4,886,210 | A | 12/1989 | Gaffney et al. |
| 5,165,121 | A | 11/1992 | McTargett et al. |
| 5,261,633 | A | 11/1993 | Mastro |
| 5,279,005 | A | 1/1994 | Valley |
| 5,480,193 | A | 1/1996 | Echols et al. |
| 5,527,071 | A | 6/1996 | Briggs |
| 6,070,280 | A | 6/2000 | Ko |
| 6,138,716 | A | 10/2000 | Yen |
| 6,158,469 | A | 12/2000 | Yen |
| 6,175,972 | B1 | 1/2001 | Wales |
| 6,192,529 | B1 | 2/2001 | Jones et al. |
| 6,195,818 | B1 | 3/2001 | Rodstein et al. |
| 6,276,004 | B1 | 8/2001 | Bertrand et al. |
| 6,301,727 | B1 | 10/2001 | Bertrand et al. |
| 6,334,463 | B1 | 1/2002 | Lee |
| 6,364,179 | B1 | 4/2002 | Sullivan |
| 6,378,912 | B1 | 4/2002 | Condon et al. |
| 6,449,784 | B1 | 9/2002 | Pelletz |
| 6,588,453 | B2 | 7/2003 | Marty et al. |
| 6,615,422 | B2 | 9/2003 | Hecker |
| 6,634,380 | B2 | 10/2003 | Bartkus et al. |
| 6,725,472 | B2 | 4/2004 | Gray et al. |
| 6,840,267 | B1 | 1/2005 | Jennings et al. |
| 6,925,662 | B1 | 8/2005 | Tan et al. |
| 7,104,519 | B2 | 9/2006 | O'Maley et al. |
| 7,191,794 | B2 | 3/2007 | Hodges |
| 7,258,322 | B1 | 8/2007 | Yang |
| 7,373,674 | B1 | 5/2008 | Condon |
| 7,458,449 | B2 | 12/2008 | Sennhauser |
| 7,793,365 | B2 | 9/2010 | Miura et al. |
| 7,857,286 | B1 | 12/2010 | Huang |
| 2009/0019636 | A1 | 1/2009 | Kajuch et al. |

OTHER PUBLICATIONS

Office Action for U.S. Appl. No. 12/244,423, mail date Apr. 15, 2011, 10 pages.

Amendment and Reply for U.S. Appl. No. 12/244,423, mail date Aug. 15, 2011, 9 pages.

Office Action for U.S. Appl. No. 12/244,423, mail date Sep. 29, 2011, 8 pages.

Amendment and Reply for U.S. Appl. No. 12/244,423, mail date Nov. 28, 2011, 11 pages.

Advisory Action for U.S. Appl. No. 12/244,423, mail date Dec. 6, 2011, 3 pages.

International Search Report and Written Opinion for Application No. PCT/US2009/005358, mail date Jan. 18, 2010, 11 pages.

International Preliminary Report for Application No. PCT/US2009/005358, mail date Apr. 14, 2011, 7 pages.

Notice of Allowance on U.S. Appl. No. 12/244,423, mail date Mar. 12, 2012, 8 pages.

* cited by examiner

SLIP-FIT CLAMPING SYSTEM FOR MOUNTING A FITTING ON A WALL

CROSS-REFERENCE TO RELATED PATENT APPLICATIONS

This application is a Continuation of U.S. patent application Ser. No. 12/244,423, titled "Slip-Fit Clamping System for Mounting a Fitting on a Wall" and filed on Oct. 2, 2008, which is incorporated herein by reference in is entirety.

STATEMENT OF FEDERALLY SPONSORED RESEARCH OR DEVELOPMENT

Not applicable.

BACKGROUND

This invention relates to bath spouts, hand shower holders, shower arms for supporting shower heads, and other wall mountable fittings used in bathrooms and the like. More particularly it relates to clamping systems to mount such items onto their supports.

In the installation of plumbing fittings such as tub spouts it is often necessary to attach the fitting to a water supply pipe or the like that extends essentially horizontally through the wall. In connection with typical installations the spout is slid over the end of the water pipe until a rearward end of the spout is positioned flush with an outer surface of the room wall. Then, the spout is fixed in place using varied means. See e.g. U.S. Pat. Nos. 2,997,058 (set screw driving a cylindrical intermediary member), 3,656,503 (threaded connection between end of supply pipe and spout) and 4,886,210 (set screw).

A desirable mounting will secure the fixture to the water supply pipe so as to prevent the fixture from sliding or rotating on the pipe after installation. However, at the same time, it is usually desirable to leave the option to remove the spout for maintenance purposes, or to facilitate remodeling of the adjacent wall surface.

Regardless, the means of mounting should minimize the possibility of damaging the water pipe, either during initial assembly, or by creating a weakened point where cracks, leaks or corrosion can develop over time. For example, driving a set screw through the spout directly against the supply pipe (see e.g. U.S. Pat. No. 6,301,727) can provide a secure connection but may weaken a portion of the supply pipe if not done carefully to avoid overtightening.

There have been attempts to use a clamp to retain the water supply pipe (see e.g. U.S. Pat. No. 7,258,322). However, this disrupts the rear aesthetics of the spout to accommodate the bulky clamp mechanism and side wall screw, and requires a relatively costly clamping part to be produced.

Somewhat similar needs have arisen with respect to mounting other types of bathroom fittings and the like onto essentially horizontally extending support posts or rods. Again, there is a desire to avoid damaging the support when removably installing the fitting.

Hence, a need exists for improved mounting assemblies for mounting bathroom fittings and the like on pipes, rods or the like.

SUMMARY

The present invention provides a fitting suitable to be mounted on a member selected from the group consisting of pipes and rods, where the member is positionable to extend essentially horizontally through an essentially vertical wall.

The fitting includes a fitting body having a rear axially extending cavity for receiving the member in a telescoping fashion.

The fitting further includes a clamp structure having at least two separate clamp parts. The clamp structure is configured so as to be positionable around the member between the member and fitting body when the member is inserted in the cavity. A hole, in which a screw is located, extends radially from the cavity through a wall of the fitting body. If an end of the member is positioned in the cavity, then the screw can be extended radially inward to drive against a first of the separate clamp parts. This causes that clamp part to help retain the end of the member in the cavity.

In a particularly preferred form of the invention, the fitting is a tub spout mountable to a water supply pipe in the wall.

In another form, the fitting is a combined holder for a personal showerhead and a supply connector for linking to a supply hose of the personal showerhead. Preferably the supply connector is at a lower portion of the fitting and the holder is at a peripheral side of the fitting.

In still yet another form, the fitting is a shower arm of a showerhead.

The two separate clamp parts both may be arcuate. If the two separate clamp parts are positioned around the member, then they may essentially surround the member. The two separate clamp parts may be essentially identical to each other. The two separate clamp parts may also be configured with interfitting teeth at their respective ends which can be made to overlap when the two separate clamp parts are positioned to abut against each other.

At least one of the clamp parts may have a cupped socket for receiving the screw when the screw is extended radially inward. The cupped socket may be part of a projection that extends radially outward. The projection may restrict rotation within the fitting body of the clamp part which has the projection.

There may be one or more washer(s) and/or o-ring(s) positioned in the cavity such that, when a member is inserted in the cavity, they encircle the member. The clamp structure will then help retain them. The o-ring forms a seal between the member and the fitting body.

In another aspect the invention provides a fitting including a fitting body having a rear axially extending cavity for receiving the member in telescoping fashion. At least one washer and at least one o-ring are positioned in the cavity. The fitting further includes a clamp structure that has at least two separate clamp parts. The clamp structure is configured to be positionable around the member between the member and the fitting body if the member is inserted in the cavity. A hole, in which a screw is located, extends radially from the cavity through a wall of the fitting body. If an end of the member is positioned in the cavity, then the screw can be extended radially inward to drive against a first of the separate clamp parts. This causes that clamp part to help retain the end of the member in the cavity. Further, when the member is inserted in the cavity, the at least one washer and o-ring encircle the member. The clamp structure helps to retain the at least one washer and the o-ring in the cavity and the o-ring forms a seal between the member and the fitting body.

At least one of the separate clamp parts may have a pocket for receiving the screw. When the screw is extended radially inward to drive against a first of the clamp parts, which in turn captures the top clamp via interlocking teeth, the at least one washer and o-ring may be captured by the clamp structure such that the o-ring forms a seal between the member and the fitting body.

In another aspect the invention provides a bathtub diverter spout assembly. The bathtub diverter spout assembly includes a water supply pipe that extends essentially horizontally through an essentially vertical bathroom wall and a spout body having a frontal outlet and a rear axially extending cavity.

A valve is positioned in the spout body for restricting flow through the frontal outlet when it is desired for flow to be diverted away from the outlet. An end of the water supply pipe is positioned in the cavity in telescoping fashion. A clamp structure is positioned around the water supply pipe and between the pipe and an internal wall of the cavity. The clamp structure has at least two separate arcuate clamp parts.

A hole extends radially from the cavity through a wall of the spout body. A screw is in the hole. Extending the screw radially inward can cause the screw to push against a first of the separate arcuate clamp parts, which in turn will cause that clamp part to help retain the end of the pipe in the cavity.

In yet another aspect the present invention also provides a hand shower holder assembly. The hand shower holder assembly includes a water supply pipe that extends essentially horizontally through an essentially vertical bathroom wall. The hand shower holder assembly further includes a hand shower holder body having a supply connector for connection to a hose and a rear axially extending cavity.

An end of the water supply pipe is positioned in the cavity in telescoping fashion. A clamp structure is positioned around the water supply pipe between the pipe and an internal wall of the cavity. The clamp structure has at least two separate arcuate clamp parts. A hole, with a screw in it, extends radially from the cavity through a wall of the hand shower body. Extending the screw radially inward can cause the screw to push against a first of the separate arcuate clamp parts, which in turn will cause that clamp part to help retain the end of the pipe in the cavity.

In still yet another aspect, the present invention also provides a shower arm assembly. The shower arm assembly includes a water supply pipe that extends essentially horizontally through an essentially vertical bathroom wall. The shower arm assembly further includes a shower arm having a front end linked to a showerhead and a rear axially extending cavity.

An end of the water supply pipe is positioned in the cavity in telescoping fashion. A clamp structure has at least two separate arcuate clamp parts and is positioned around the water supply pipe between the pipe and an internal wall of the cavity. A hole, with a screw in it, extends radially from the cavity through a wall of the shower arm. Extending the screw radially inward can cause the screw to push against a first of the separate arcuate clamp parts, which in turn will cause that clamp part to help retain the end of the pipe in the cavity.

Thus, the present invention provides improved assemblies for attaching a fitting such as a tub spout, hand shower holder, shower arm for a showerhead, or the like to a support member (e.g. a water supply pipe) extending from the surface of a wall. When the set screw is tightened, one of clamp parts is driven towards the other clamp parts to securely grip and capture the pipe and retain it in the cavity. Untightening the screw permits the spout or other fitting to be easily removed.

By using this clamping system the secure connection benefits of a set screw are achieved, but the risk of damage to the gripped pipe is greatly reduced. Further, in that the clamp can be made of an optimal material, the risk of corrosion can be reduced.

The clamp parts are inexpensive to produce and can be installed and used in an intuitive manner. Thus, a reliable system can be provided at acceptable cost.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Figure 1:
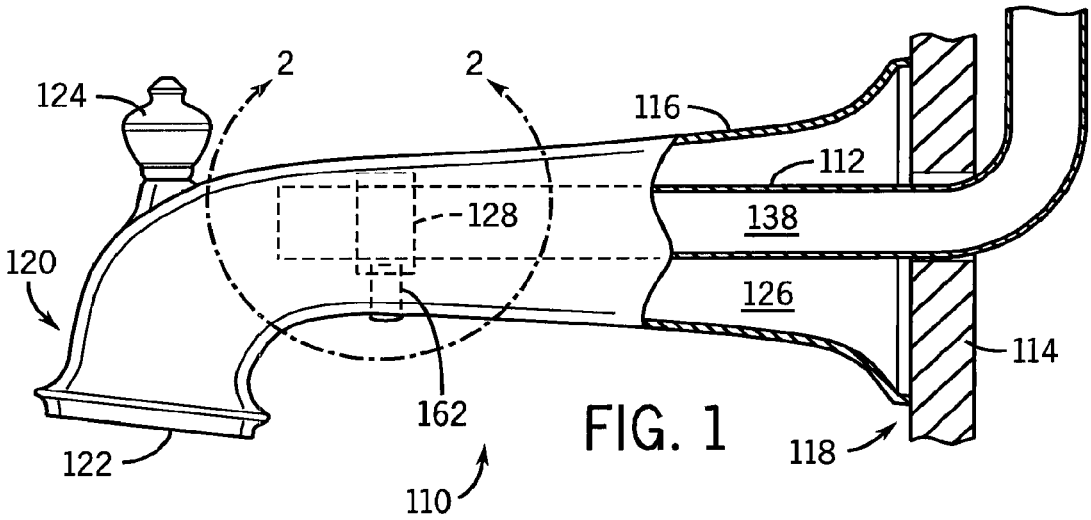
FIG. 1 is a partially fragmentary side elevational view of a tub spout of the present invention.
Figure 2:
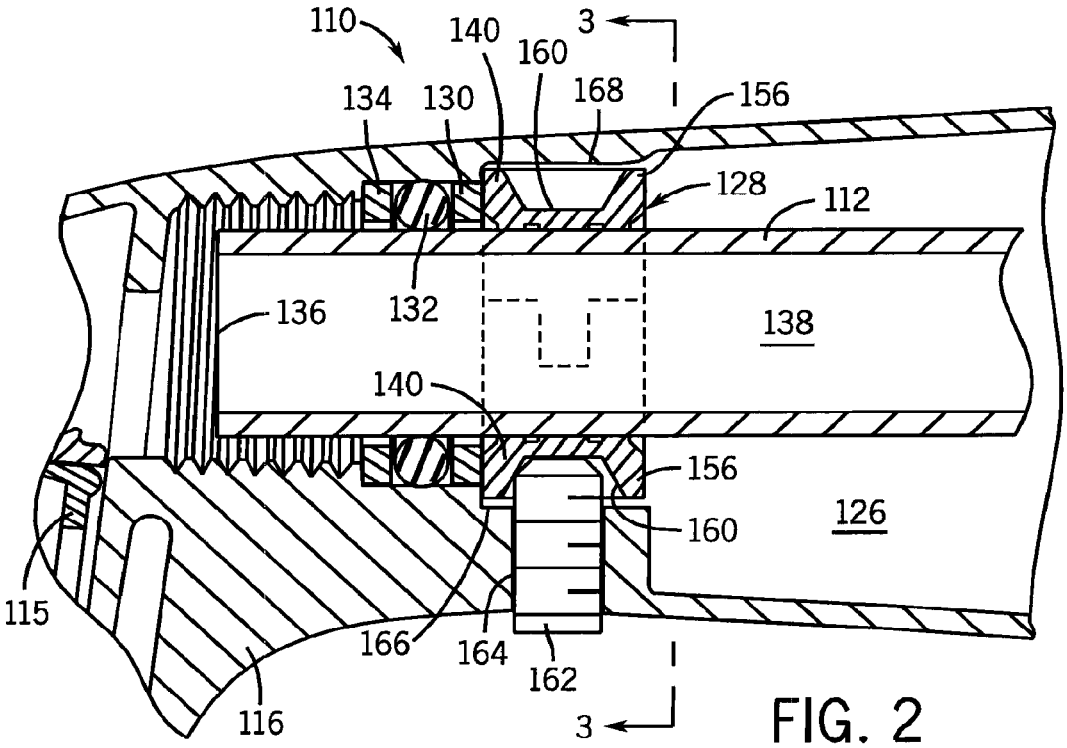
FIG. 2 is a cross-sectional view taken along line 2-2 of FIG. 1.
Figure 3:
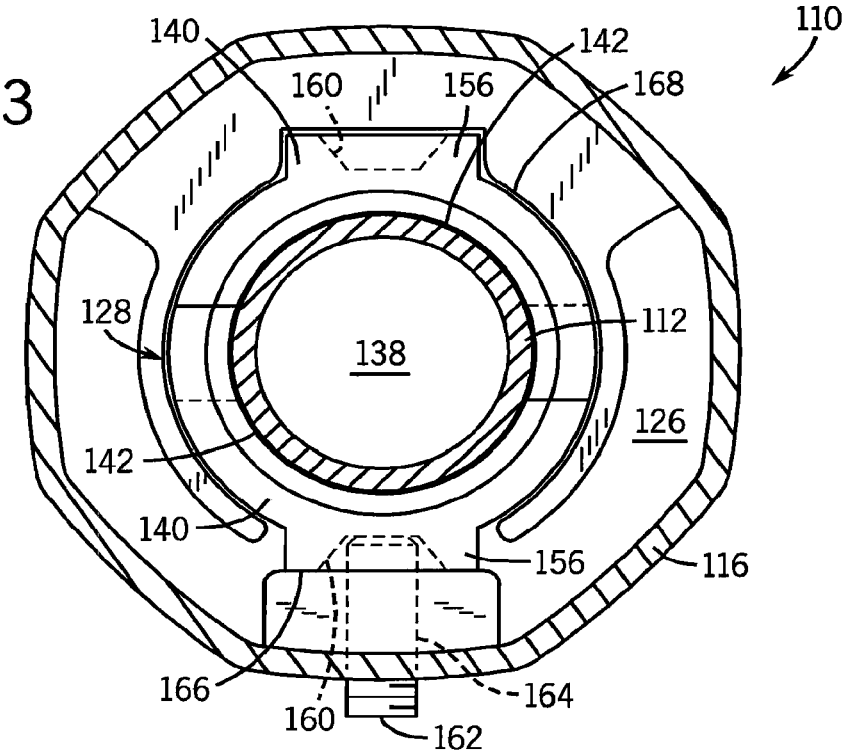
FIG. 3 is a cross-sectional view taken along line 3-3 of FIG. 2.

Referring first to FIGS. 1-3, a bathtub spout 110 is shown attached to a water pipe 112 that extends essentially horizontally through an essentially vertical wall 114. The bathtub spout 110 has a main spout body 116 extending from a rear end 118 that is flush with an outer surface of the room wall 114 to a front end 120 that has a downward extending frontal outlet 122.

Proximate the frontal outlet 122, a diverter control 124 controls a valve 115 located in the spout body 116. The diverter control 124 can be used in a conventional manner to restrict the flow of water through the frontal outlet 122 when it is desired for the flow to instead be diverted away from the frontal outlet 122 and to, for example, a showerhead (not shown). As is well known, when such a diverter control 124 is in the down position the valve is open and any water from the water pipe is directed to the frontal outlet 122 (and thus typically to a tub below it). If instead the diverter control 124 is pulled up, then the valve 115 is closed and water is prevented from flowing from the frontal outlet 122. Instead, the water is then diverted to the showerhead or the like.

At the rear end 118 of the spout body 116, a rear axially extending cavity 126 telescopically receives the water pipe 112. The water pipe 112 extends through the rear axially extending cavity 126, through a clamp structure 128, and then past a first plastic washer 130, an o-ring 132, and a second plastic washer 134. At the end of the water pipe 112, an opening 136 places the passageway 138 of the water pipe 112 in fluid communication with frontal outlet 122 (absent being blocked by the diverter valve).

Figure 4:
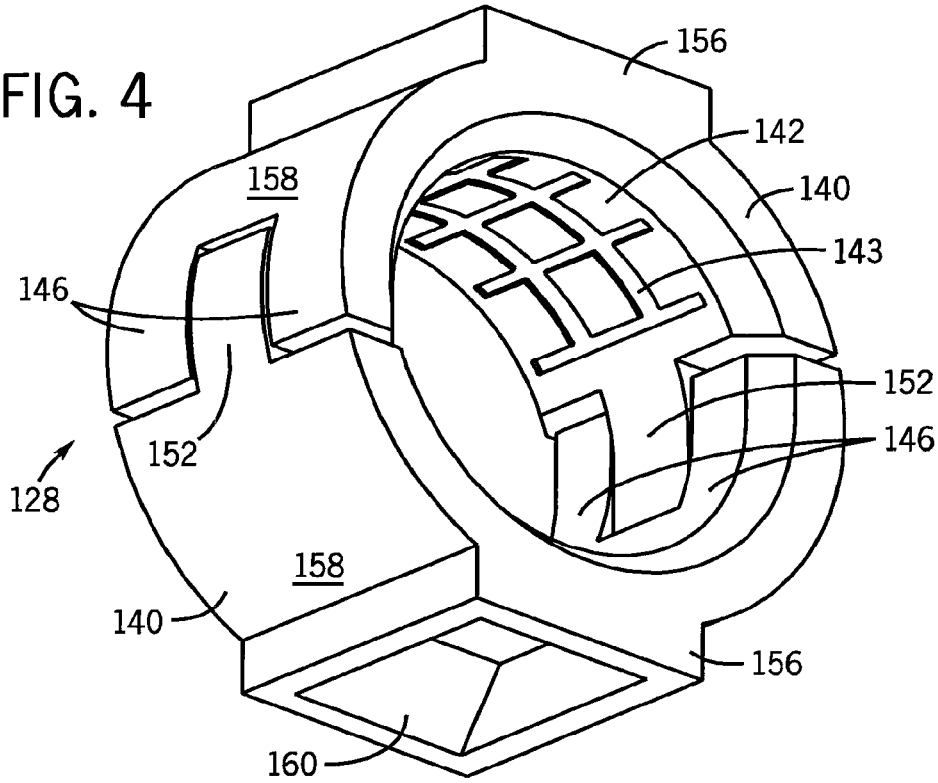
FIG. 4 is a lower right frontal perspective view of two clamp parts of the present invention, that are interfit.
Figure 5:
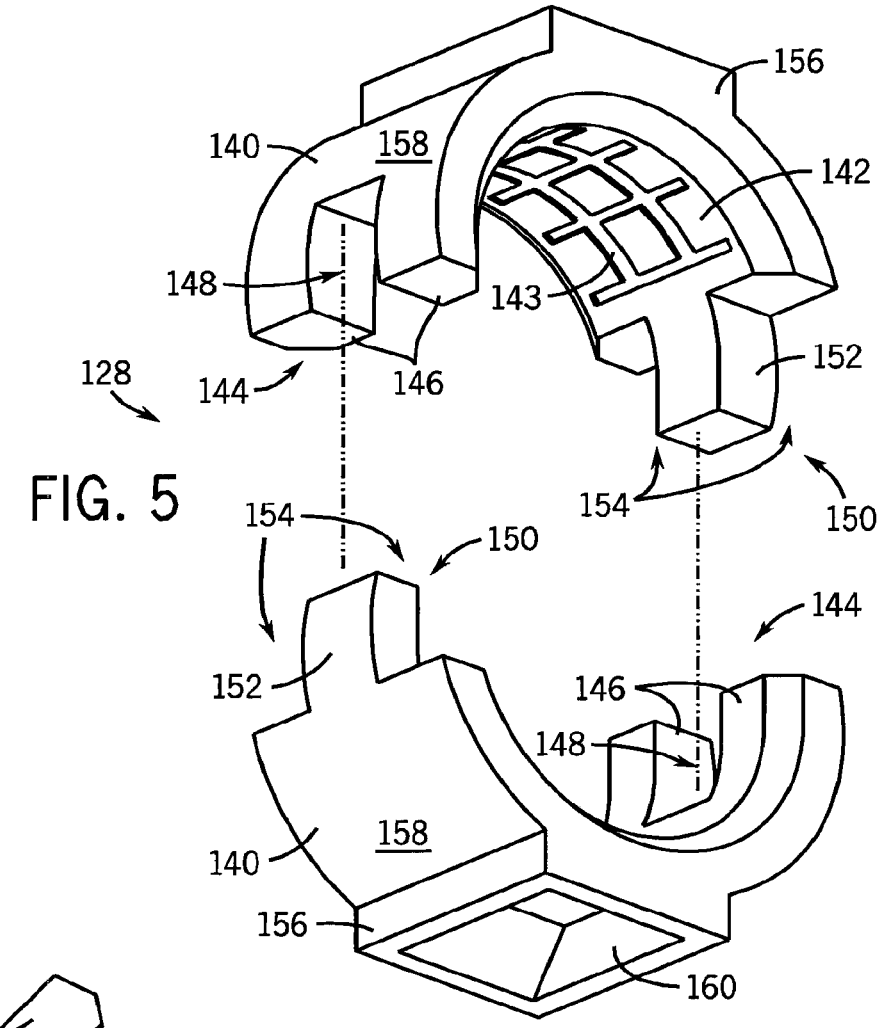
FIG. 5 is a view similar to FIG. 4, but with the two clamped parts exploded away from each other.
Figure 6:
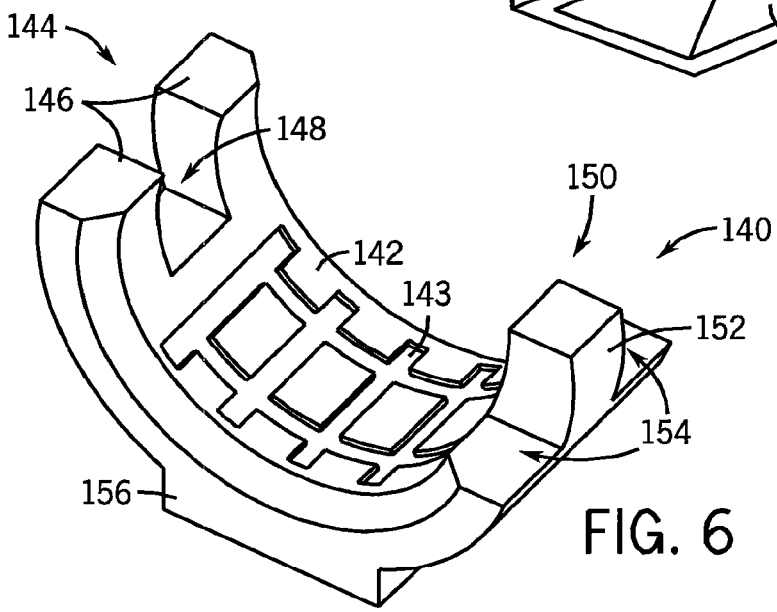
FIG. 6 is a top left perspective view of one of the clamp parts.

Notably, a multi-part clamp structure 128 circumferentially grips the water pipe 112 to secure the bathtub spout 110 to the water pipe 112. As can be seen in FIGS. 4-6, the clamp structure 128 includes two separate clamp parts 140. These clamp parts 140 are preferably essentially identical to one another.

Each of the clamp parts 140 has an arcuate surface 142. When positioned and clamped around the water pipe 112, these arcuate surfaces 142 grip around the water pipe 112 and essentially surround the water pipe 112. The arcuate surface 142 may include a pattern 143 to gently "bite" into the outer surface of the water pipe 112 to prevent movement of the bathtub spout 110 relative to the water pipe 112. However, any "bite" is distributed circumferentially around the outer surface of the water pipe 112 so as not to severely damage any particular portion of it. As shown, the pattern 143 includes axial and circumferential relief strips that are radially offset from the rest of the arcuate surface 142.

Each of the two clamp parts 140 is configured with interfitting teeth at their respective ends which can be made to overlap when the two separate clamp parts 140 are positioned to abut against each other (as shown, for example, in FIG. 4). Each of the clamp parts 140 has an end 144 with two teeth 146 having a space 148 therebetween and another end 150 having a tooth 152 with spaces 154 located on either side thereof. When the clamp parts 140 are assembled, the teeth and spaces of each of the ends 144 and 150 of each of the clamp parts 140 interfit with the other interfitting ends 144 and 150 of the other clamp part 140.

Each of the clamp parts 140 also has a projection 156 that extends radially outward from an outer surface 158. The projection 156 serves two purposes. First, the projection 156 has a cupped socket 160 for receiving a screw 162 that drives the clamp parts 140 toward one another. As can be seen in FIGS. 1-3, the spout body 116 has a hole 164 that receives the screw 162. The hole 164 extends radially from the cavity 126 though a wall 166 of the spout body 116 proximate the clamp structure 128. The screw 162 is threaded through the hole 164 and can be extended radially inward, by rotation or the like, to drive one of the clamp parts 140 towards the other of the clamp parts 140 to clamp around the water pipe 112.

Second, the projection 156 gives the outer surface 158 of clamp structure 128 a non-cylindrical profile. This non-cylindrical profile prevents the rotation of the clamp structure 128 within the cavity 126 of the spout body 116. The inner walls 168 of the portion of the cavity 126 into which the clamp structure 128 is placed have a profile that closely matches the outer profile of the clamp structure 128. In this way, the projection 156 on each of the clamp parts 140 helps to prevent the clamp structure 128 from rotating relative to the water pipe 112 once the clamp structure 128 has been secured to the water pipe 112. Further, as the clamp structure 128 can not be significantly rotated within the cavity 126, the cupped socket 160 remains aligned with the screw 162 and hole 164.

Preferably, at least one of the clamp parts 140 is made of zinc when the water supply tube is made of copper. Although the clamp parts 140 may be fabricated in a number of ways, it is contemplated that they may be cast.

The bathtub spout 110 is mounted to the water pipe 112 extending from the wall 114 in the following manner. First, the clamp parts 140 are mated to one another to form a ring-like structure as shown in FIG. 4. The resulting clamp structure is then inserted into the cavity 126 of the spout body 116. In some forms of the invention, the clamp structure 128 is seated in an interior portion of the spout body 116 having a profile that closely matches the outer profile of the clamp structure 128.

Next, the screw 162 may be loosely tightened to retain the clamp structure 128 in the spout body 116. However, the clamp parts 140 should still be loose enough that they can be slid over the water pipe 112. The clamp parts 140 are then telescopically slid over the water pipe 112 until the rear end 118 of the bathtub spout 110 is flush to the surface of the wall 114 or at the desired location. As this occurs, the bathtub spout 110 may be axially rotated around the pipe to a desired orientation.

Once the bathtub spout 110 is positioned as desired, the screw 162 is driven radially inward by a screw driver, hex key, or the like, to press one of the clamp parts 140 into the other of the clamp parts 140. As the clamp parts 140 are driven together, they clamp around the water pipe 112. The action of the screw 162 also moves both clamp parts 140 towards a top surface of the inner wall 168 of the spout body 116. Thus, the radially inward action of the screw 162 secures the clamp parts 140 around the water pipe 112 and further fixes the location the clamp parts 140 relative to the spout body 116.

If necessary the screw 162 can be driven radially away from the water pipe 112 to help unmount the clamp parts 140 from the water pipe 112. This could be done, for example, when a bathroom wall is being retiled.

It should be appreciated that the clamp structure 128 retains the washers 130 and 134 and the o-ring 132 in the cavity 126. Thus, as the water pipe 112 or other member is telescopically slid into the cavity 126, the washers 130 and 134 and the o-ring 132 encircle the water pipe 112 to form a seal around the water pipe 112. This seal prevents water from leaking back past the clamp structure 128 and out the end of the fitting abutting the wall 114. Notably, as the clamp structure 128 can be entirely removed from the cavity 126, this allows for the o-ring to be placed downstream of the clamp structure 128. This isolates the clamp structure 128 from exposure to water. If the clamp structure was not wholly removable from the cavity (because, for example, half of the clamping structure was integrally cast with the tub spout), then the o-ring would need to be placed on the other side of the clamping structure such that the clamping structure might be exposed to water and susceptible to leaking and/or corrosion.

Figure 8:
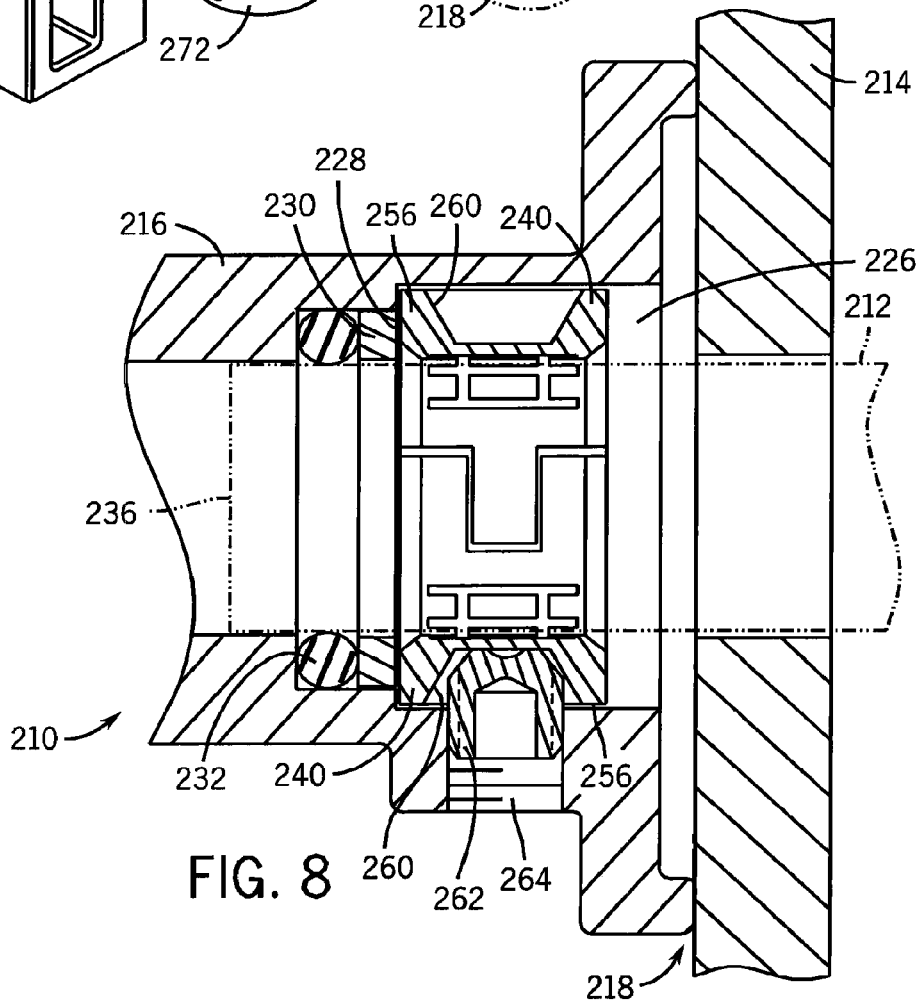
FIG. 8 is a cross-sectional view taken along line 8-8 of FIG. 7.
Figure 10:
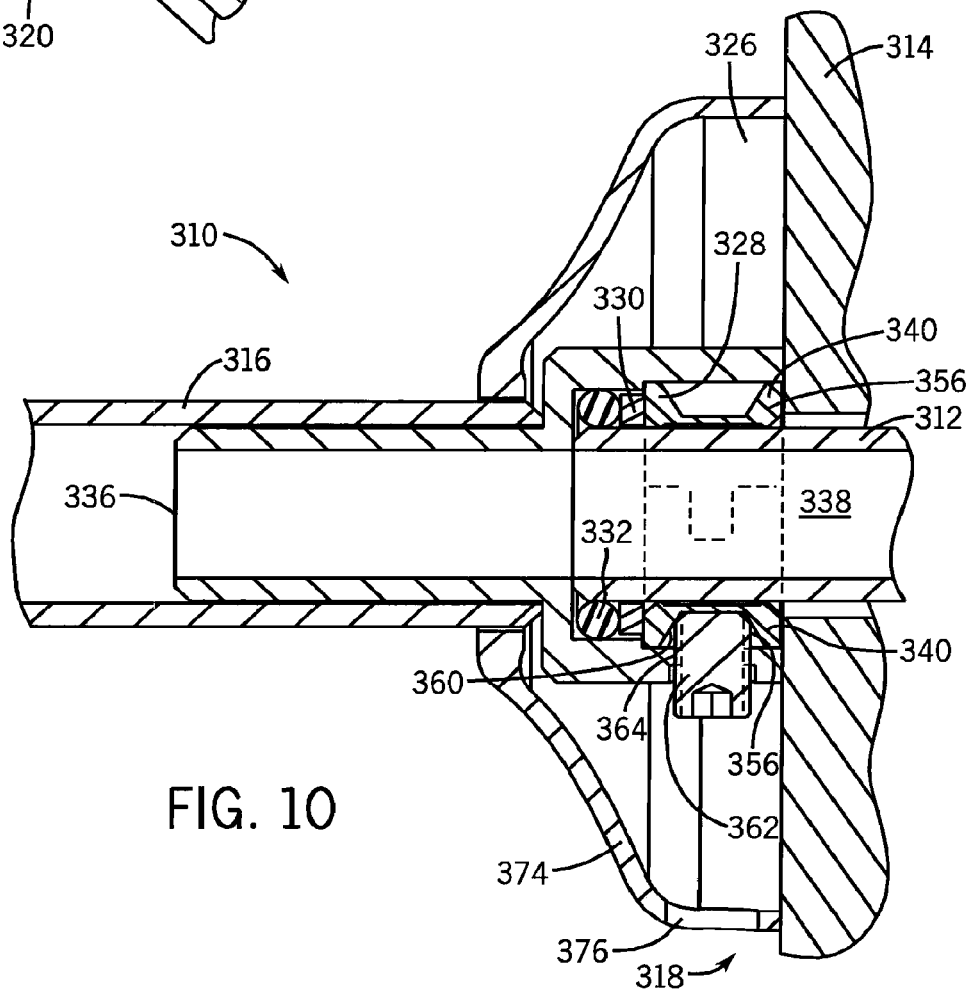
FIG. 10 is an enlarged cross-sectional view taken of region 10-10 of FIG. 9.

It is contemplated that, as can be seen in FIGS. 8 and 10, there may be an o-ring that is placed between a single washer and a surface of the cavity to form a seal around the water pipe or other member. Thus, two washers may not be necessary to provide a groove for the o-ring.

It should be appreciated that the bathtub spout 110 is merely one form of the invention. The fitting may be numerous other types of plumbing fittings, bathroom accessories or the like. Although the bathtub spout 110 is shown with a diverter, it is contemplated the clamp structure 128 could be used in any kind of spout whether or not the spout includes a diverter.

Further, it should be appreciated that although, as shown, the fitting is mounted to a water pipe 112, that the fitting may be mounted on any one of a number of types of support members. It is contemplated that the fitting could be mounted on a member selected from the group consisting of pipes and rods.

In this regard, further forms of the present invention will now be described. As most of the parts perform similar functions, like numerals having an increased leading digit will be used to indicate like components. For example, the water pipe 112 corresponds to the water pipe 212 or the water pipe 312. The description of each of these components above will apply to each corresponding component below, unless otherwise indicated.

Figure 7:
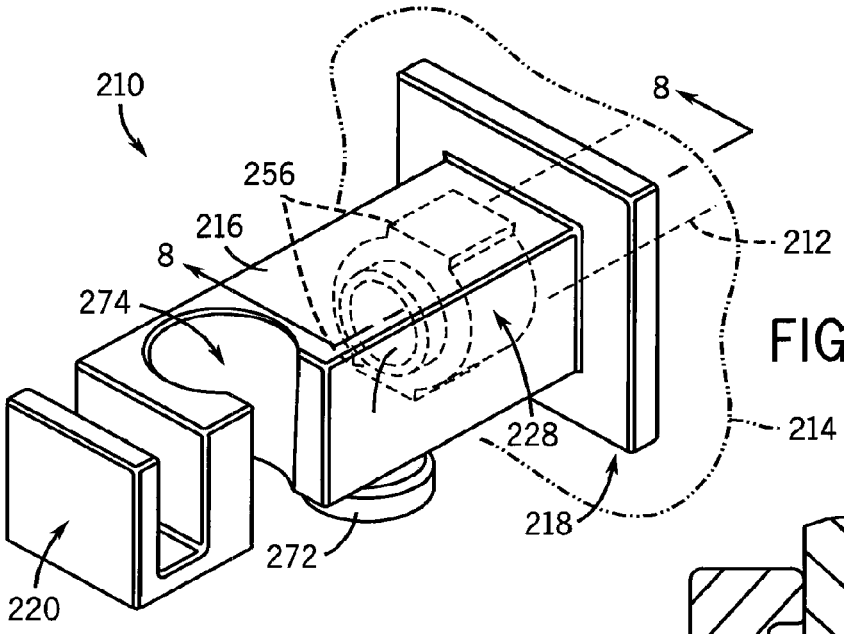
FIG. 7 is a right frontal upper perspective view of a hand shower holder of the present invention.

Referring now to FIGS. 7 and 8, a hand shower holder 210 is shown mounted to a water pipe 212. The hand shower holder 210 is similar to the bathtub spout 110 in the manner in which it is connected to the water pipe 112 or 212. The hand shower holder 210 is attached to the water pipe 212 in the manner described above. The screw 262 is driven radially inward to clamp the clamping structure 228 around the water pipe 212.

In the hand shower holder 210, the water pipe 212 is in fluid communication with a supply connector 272 on the lower portion of the hand shower holder 210. This supply connector 272 can be connected to a hose that directs the water to a personal hand shower or the like. The personal hand shower may dock with a holder 274 proximate the front end 220 or a peripheral side of the hand shower holder 210. It may be desirable to dock the hand shower when it is not in use or when the user wants the hand shower be held at the location of the hand shower holder 210 so that it may function as an overhead shower.

Figure 9:
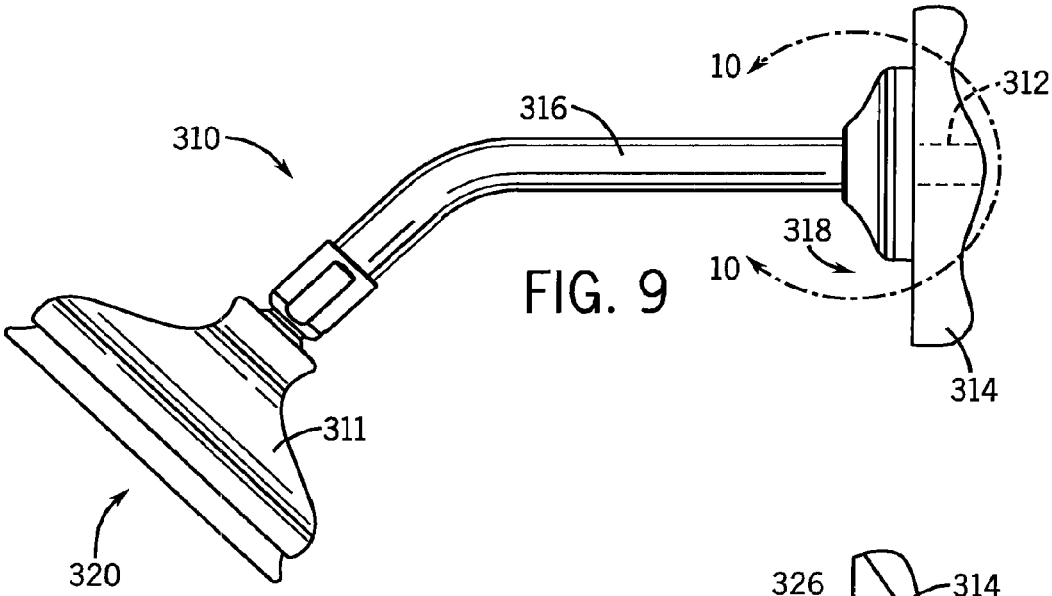
FIG. 9 is a side elevational view of a shower arm assembly of the present invention.

Referring now to FIGS. 9 and 10, a shower arm 310 supporting a showerhead 311 is shown mounted to a water pipe 312. The shower arm 310 is similar to the bathtub spout 110 and the hand shower holder 210 in the manner in which it is connected to the water pipe. The shower arm 310 is attached to the water pipe 312 in the manner described above. The screw 362 is driven radially inward to clamp the clamping structure 328 around the water pipe 212.

Notably, as the shower arm 310 has a escutcheon portion 374 that is flared outward. To provide access to the screw 362, the escutcheon has a hole 376 that allows a tool to be extended through the escutcheon portion 374 to engage the screw 362.

Thus, the present invention provides a fitting for mounting a fixture to a member. The fitting is compact and able to mount the fixture to a member with the simple rotation of a screw or the like. However, the present invention does not provide a point load on the member. Thus, any overtightening of the screw will not locally deform, for example, a water pipe and cause leakage and corrosion. Rather, the clamping load is distributed over the circumference of the member.

Additionally, the present invention provides a manner of connection that does not significantly compromise the aesthetic of the fixture being attached. The access point to the screw can be on the underside of the fixture and concealed from plain sight. This allows for more flexibility in the exterior product design and reduces the structural limitations due to the mounting structure.

It should be appreciated that various other modifications and variations to the preferred embodiments can be made within the spirit and scope of the invention. Therefore, the invention should not be limited to the described embodiments. To ascertain the full scope of the invention, the following claims should be referenced.

INDUSTRIAL APPLICABILITY

The invention provides a fitting (e.g. a tub spout) suitable to be mounted on a member (e.g. a water supply pipe), and particular clamping structures to facilitate that mounting.

What is claimed is:

1. A fitting suitable to be mounted on a member selected from the group consisting of pipes and rods, where the member is positionable to extend essentially horizontally through an essentially vertical wall, the fitting comprising:

a fitting body having a rear axially extending cavity for receiving the member in telescoping fashion, the fitting defining a hole extending radially from the cavity through a wall of the fitting body;

a clamp structure having at least two separate non-integral clamp parts, the clamp structure being configured so as to be positionable around the member between the member and the fitting body if the member is inserted in the cavity; and a screw in the hole;

whereby, if an end of the member is positioned in the cavity the screw can be extended radially inward to drive against a first of the separate non-integral clamp parts, which in turn will cause the first of the separate non-integral clamp parts to help retain the end of the member in the cavity without having the screw drive directly against the member;

wherein at least one of the clamp parts has a cupped socket against which an end of the screw pushes when the screw is extended radially inward, the cupped socket being substantially defined by a projection that extends radially outward from an outer surface of the at least one of the clamp parts.

2. The fitting of claim 1, wherein the fitting is a wall-mountable spout.

3. The fitting of claim 2, wherein the spout is a tub spout.

4. The fitting of claim 1, wherein the fitting is a shower arm that is linked to a showerhead.

5. The fitting of claim 1, wherein the fitting is a combined holder for a personal showerhead and a supply connector for linking to a supply hose of the personal showerhead.

6. The fitting of claim 5, wherein the supply connector is at a lower portion of the fitting and the holder is at a peripheral side of the fitting.

7. The fitting of claim 1, wherein the at least two separate non-integral clamp parts are both arcuate.

8. The fitting of claim 7, wherein if the at least two separate non-integral clamp parts are positioned around the member they can essentially surround the member.

9. The fitting of claim 7, wherein the at least two separate non-integral clamp parts are essentially identical to each other.

10. The fitting of claim 1, wherein the at least two separate non-integral clamp parts are configured with interfitting teeth at their respective ends which can be made to overlap when the at least two separate non-integral clamp parts are positioned to abut against each other.

11. The fitting of claim 1, wherein the projection can restrict rotation, within the fitting body, of the clamp part which has the projection.

12. The fitting of claim 1, further comprising at least one washer and at least one o-ring positioned in the cavity such that, when the member is inserted in the cavity, the at least one washer and o-ring encircle the member and wherein the clamp structure helps retain the at least one washer and o-ring in the cavity and the at least one o-ring forms a seal between the member and the fitting body.

13. A fitting suitable to be mounted on a member selected from the group consisting of pipes and rods, where the member is positionable to extend essentially horizontally through an essentially vertical wall, the fitting comprising:

a fitting body having a rear axially extending cavity for receiving the member in telescoping fashion, the fitting defining a hole extending radially from the cavity through a wall of the fitting body;

at least one washer and at least one o-ring positioned in the cavity;

a clamp structure having at least a first and a second separate non-integral clamp parts, the clamp structure being configured so as to be positionable around the member between the member and the fitting body if the member is inserted in the cavity; and a screw in the hole, the screw having an end;

whereby, if an end of the member is positioned in the cavity, the screw can be extended radially inward to drive the end of the screw against the first clamp part, which in turn will cause the first clamp part to help retain the end of the member in the cavity without having the screw drive directly against the member; and wherein, when the member is inserted in the cavity, the at least one washer and the at least one o-ring encircle the member and wherein the clamp structure helps to retain the at least one washer and the at least one o-ring in the cavity and the at least one o-ring forms a seal between the member and the fitting body;

wherein, when the screw is driven against the first clamp part, the screw is subject to compressive forces by the first clamp part.

14. The fitting of claim 13, wherein at least one of the first and second clamp parts has a pocket against which the end of the screw pushes when the screw is extended radially inward.

15. A fitting suitable to be mounted on a member selected from the group consisting of pipes and rods, where the member is positionable to extend essentially horizontally through an essentially vertical wall, the fitting comprising:

a fitting body having a rear axially extending cavity for receiving the member in telescoping fashion;

a clamp structure having a first clamp part and a second clamp part, the first and second clamp parts being non-integral clamp parts, and the clamp structure being configured so as to be positionable around the member between the member and the fitting body if the member is inserted in the cavity;

a threaded surface extending radially from the cavity through a wall of the fitting body and defining a hole therethrough; and a screw located in the hole and having an end configured to drive against the first clamp part;

wherein extending the screw radially inward causes the end of the screw to drive the first clamp part towards the second clamp part, thereby causing the clamp structure to help retain the end of the member in the cavity without having the screw drive directly against the member;

wherein, when the screw is driven against the first clamp part, the screw is subject to compressive forces by the first clamp part.

16. The fitting of claim 15, wherein at least one of the clamp parts has a cupped socket against which the end of the screw pushes when the screw is extended radially inward.

17. The fitting of claim 15, wherein the screw comprises a thread, and wherein the thread of the screw engages the threaded surface.

18. A fitting suitable to be mounted on a member selected from the group consisting of pipes and rods, where the member is positionable to extend essentially horizontally through an essentially vertical wall, the fitting comprising:

a fitting body having a rear axially extending cavity for receiving the member in telescoping fashion, the fitting defining a hole extending radially from the cavity through a wall of the fitting body;

a clamp structure having at least two separate non-integral clamp parts, the clamp structure being configured so as to be positionable around the member between the member and the fitting body if the member is inserted in the cavity; and a screw in the hole;

whereby if an end of the member is positioned in the cavity the screw can be extended radially inward to drive against a first of the separate non-integral clamp parts, which in turn will cause the first of the separate non-integral clamp parts to help retain the end of the member in the cavity without having the screw drive directly against the member;

wherein, when the screw is driven against the first of the separate non-integral clamp parts, the screw is subject to compressive forces by the first clamp part.

19. The fitting of claim 18, further comprising at least one washer and at least one o-ring positioned in the cavity such that, when the member is inserted in the cavity, the at least one washer and o-ring encircle the member and wherein the clamp structure helps retain the at least one washer and o-ring in the cavity and the at least one o-ring forms a seal between the member and the fitting body.

20. The fitting of claim 18, wherein the first clamp part has a pocket against which an end of the screw pushes when the screw is extended radially inward.

* * * * *